US006673763B1

(12) United States Patent
Hansen et al.

(10) Patent No.: US 6,673,763 B1
(45) Date of Patent: Jan. 6, 2004

(54) PARTICLES FOR LIQUID COMPOSITIONS

(75) Inventors: Ole Regnar Hansen, Herlev (DK); Erik Marcussen, Ballerup (DK)

(73) Assignee: Novozymes A/S, Bagsvaerd (DK)

( * ) Notice: Subject to any disclaimer, the term of this patent is extended or adjusted under 35 U.S.C. 154(b) by 0 days.

(21) Appl. No.: 09/668,086

(22) Filed: Sep. 22, 2000

Related U.S. Application Data

(60) Provisional application No. 60/157,158, filed on Sep. 30, 1999.

(30) Foreign Application Priority Data

Sep. 24, 1999 (DK) ..... 1999 01358

(51) Int. Cl.[7] ..... C11D 17/08

(52) U.S. Cl. ..... 510/418; 510/142; 510/143; 510/159; 510/203; 510/205; 510/206; 510/207; 510/208; 510/222; 510/224; 510/349; 435/188

(58) Field of Search ..... 510/392, 530, 510/142, 143, 159, 203, 205, 206, 207, 208, 222, 418, 224; 435/188

(56) References Cited

U.S. PATENT DOCUMENTS

| | | | | |
|---|---|---|---|---|
| 4,016,040 A | | 4/1977 | Win et al. | 195/68 |
| 4,713,245 A | | 12/1987 | Ando et al. | 424/438 |
| 4,919,841 A | | 4/1990 | Kamel et al. | 252/186.26 |
| 5,258,132 A | | 11/1993 | Kamel et al. | 252/94 |
| 5,801,140 A | * | 9/1998 | Langley et al. | 510/530 |

FOREIGN PATENT DOCUMENTS

| | | |
|---|---|---|
| EP | 0 510 761 | 10/1982 |
| EP | 0 346 034 | 12/1989 |
| EP | 0 382 464 | 8/1990 |
| WO | WO 96/10073 | 4/1996 |
| WO | WO 97/00938 | 1/1997 |
| WO | WO 99/00471 | 1/1999 |
| WO | WO 99/00478 | 1/1999 |

OTHER PUBLICATIONS

Showell, Michael S., "Powdered Detergents", Surfactant Science Series; 1998; vol. 71; p. 140–142; Marcel Dekker.

* cited by examiner

*Primary Examiner*—Yogendra N. Gupta
*Assistant Examiner*—Eisa Elhilo
(74) *Attorney, Agent, or Firm*—Jason I. Garbell; Elias J. Lambiris

(57) ABSTRACT

The invention relates to a liquid composition comprising dispersed herein solid particles comprising a solid wax matrix, wherein an active is distributed. The invention also relates to particles in the liquid composition and the processes and uses of the composition and the particles.

32 Claims, 1 Drawing Sheet

PARTICLES FOR LIQUID COMPOSITIONS

CROSS-REFERENCE TO RELATED APPLICATIONS

This application claims priority under 35 U.S.C. 119 of U.S. provisional application No. 60/157,158 filed on Sep. 30, 1999, and Danish application no. PA 1999 01358 filed on Sep. 24, 1999, the contents of which are fully incorporated herein by reference.

TECHNICAL FIELD

This invention relates to an active containing particle of a construction which makes it suitable for incorporation in liquid compositions. Furthermore the invention relates a processes for manufacturing active containing particles and liquid compositions, such as liquid detergents, comprising the active containing particle. The invention also relates to the use of the active containing particles and liquid compositions comprising the active containing particle.

BACKGROUND

Detergent products in the form of liquid are often considered to be more convenient to use than are dry powdered or particulate detergent products. Said detergents have therefore found substantial favour with consumers. Such detergent products are readily measurable, speedily dissolved in the wash water, capable of being easily applied in concentrated solutions or dispersions to soiled areas on garments to be laundered and are non-dusting. They also usually occupy less storage space than granular products. Additionally, such detergents may have incorporated in their formulations materials which could not withstand drying operations without deterioration, which operations are often employed in the manufacture of particulate or granular detergent products.

Although said detergents have a number of advantages over granular detergent products, they also inherently possess several disadvantages. In particular, detergent composition components which may be compatible with each other in granular products may tend to interact or react with each other. Thus components such as enzymes or other actives can be especially difficult to incorporate into liquid detergent products while maintaining an acceptable degree of stability of the enzymes.

Solid enzyme containing particles are known to the art from various disclosures as well as their use in dry powder detergents. See for examples: Michael S. Showell (editor); *Powdered detergents*; Surfactant Science Series; 1998; vol. 71; page 140–142; Marcel Dekker.

However, the use of solid composite particles comprising actives such as enzymes in liquid compositions such as detergents has not been thoroughly explored field. Only a few disclosures relevant for this field have been found such as WO 96/10073 disclosing "Nonaqueous bleach-containing liquid detergent compositions"; WO 97/00938 disclosing "Nonaqueous, particulate-containing liquid detergent compositions with alkyl benzene sulfonate surfactant"; WO 99/00471 disclosing "Non-aqueous liquid detergent compositions containing enzyme particles having reduced density" and WO 99/99/00478 disclosing "Non-aqueous liquid detergent compositions containing enzyme particles". For the present invention also the disclosures U.S. Pat. No. 4,016,040; U.S. Pat. No. 4,713,245; U.S. Pat. No. 5,198,353; U.S. Pat. Nos. 5,324,445; 5,492,646 are prior art.

SUMMARY OF THE INVENTION

Figure 1:
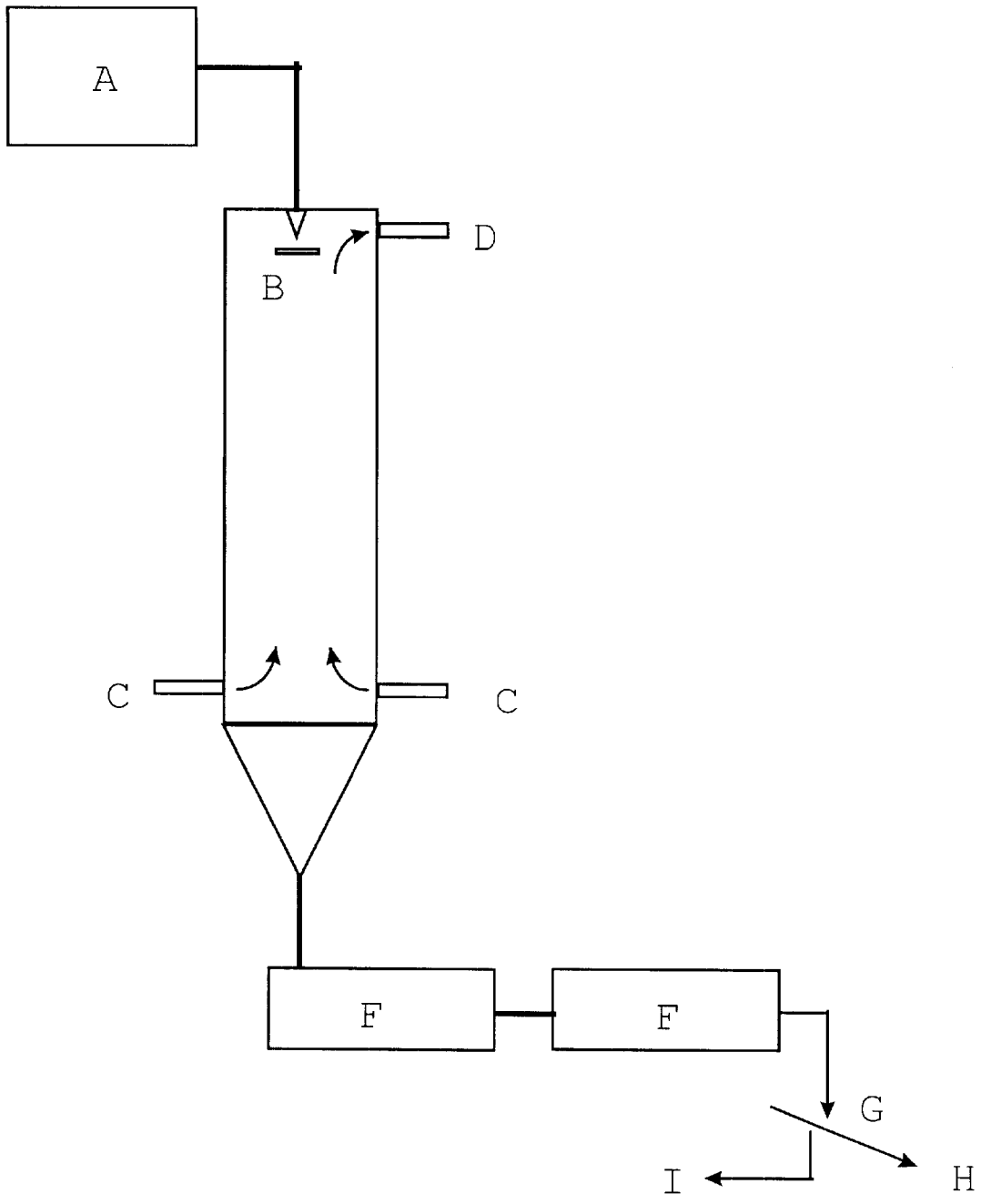
FIG. 1 shows a diagram for a process for producing enzyme containing particles of the invention. A=molten wax comprising enzyme, B=atomizer, C=cooling air inlet, D=air outlet; F=coolers; G=sieving screens; H=finished enzyme containing particles; I=odd sized particles for recirculation.

One object of the invention is to provide liquid compositions comprising an active in which the active is protected from being inactivated from other components of the composition or in which the active in inhibited in inactivating other components of the composition. We have found that this may be achieved by incorporating the active in solid particles which may be dispersed in liquid compositions. For the application of such dispersions, it is important to inhibit sedimentation, agglomeration or other forms of mechanisms which may concentrate the particles in specific parts or layers of the liquid composition incorporating the particles. Accordingly, a further object of the invention is to provide particles, which may be dispersed in a liquid composition, wherein the dispersion stability is improved. A still further object of the invention is to provide a good method for producing particles suitable for incorporating an active and in which the properties of the resulting particles may easily be adjusted to fit the properties of the liquid into which the particles are to be dispersed so as to improve the dispersion stability of the particles in the liquid composition.

We have found that particles comprising a solid wax matrix in which an active, preferably in solid particulate form, is distributed provides an excellent solution for the objects of the invention. Accordingly the invention relates to liquid compositions having dispersed in a liquid phase solid particles, wherein the solid particles comprises a solid wax matrix in which an active, preferably in solid particulate form, is distributed.

The invention also relates to a particle comprising a solid matrix of a mixture of at least two solid waxes wherein an active, preferably in solid particulate form is distributed.

The invention further relates to a particle comprising a solid matrix wherein an active, preferably in solid particulate form and a density modifier is distributed.

Still further the invention relates to processes for preparing liquid compositions of the invention and processes for preparing particles of the invention and use of liquid compositions and particles of the invention.

DETAILED DESCRIPTION OF THE INVENTION

The present invention offers several advantages: It is possible to prepare particles having a narrow size distribution and a very uniform true density of the particles. A narrow size distribution of enzyme containing particles has conventionally been desired because the true density of known particles varies with size of the particles. However with increasing uniformness of the particles true density, the size distribution becomes less important as the differences in true density between smaller and larger particles diminish. Through the process of preparing the particles of the invention, the true density of the particles may be adjusted to suit the density of the liquid in which the particles are to be dispersed and thereby enabling dispersions of particles in the liquid with an improved dispersion stability. Further the chemical and/or physical stability of the active may be improved by incorporating the active in a solid wax matrix in stead of adding the active to the liquid composition without being incorporated in the particle of the invention.

Still further, any hazards, such as dusting, toxicity and the like, in handling the active prior to forming a liquid dispersion, e.g. when the active is in pure dry form, may be lowered by incorporating the active in a wax matrix and may be further improved through coating the particle with a coating layer free of active.

Definitions

The term "true density" of a compound as used herein, is to be construed as the density in weight per volume of said compound, determined by immersing a weighed amount of the compound in a liquid in which the compound is insoluble and measuring the volume increase of liquid dispersion (i.e. the volume of liquid which is displaced by the compound). As an example, if 1 gram of a compound is added to a volume of 10 $cm^3$ of a liquid in which the compound is insoluble and by said addition the volume of the liquid-compound mixture increases to 11 $cm^3$, the compound thereby displacing 1 $cm^3$ of liquid, the true density of the compound is 1 gram per $cm^3$. The true density of a liquid may be measured as the weight of a measured volume of the liquid.

The term "wax" as used herein, is to be construed as a compound having a melting point between 25–150° C.

The term "solid wax matrix" as used herein, is to be construed as a wax in a solid particulate phase, wherein enzymes and other useful components are distributed, and wherein the wax is used for tying and/or binding the other components together to form a solid discrete and particulate entity. In an uncoated particle, the wax or mixture of waxes constituting the wax matrix constitutes at least 35% w/w of the particle in which the active and other useful components are distributed.

The term "distributed" as used herein concerning actives being distributed in a wax matrix for is to be understood as the active being evenly or homogeneously present throughout the wax matrix e.g. as active dissolved in the wax and/or as discrete clusters or particles of active homogeneously dispersed in the wax.

The Particle

The particle containing an active as provided by the invention comprises a solid wax matrix and an active, preferably in solid particulate form and optionally other useful components, which are different from the wax and the active, distributed in the solid wax matrix and the particle is optionally coated with one or more coating layers. The particle components including the coating materials are preferably dispersible or soluble in aqueous solutions containing more than 50% w/w water at neutral to alkaline pH. Useful particle sizes lies within the range of about 20 $\mu$m to about 2000 $\mu$m, preferably between about 100 $\mu$m to about 1000 $\mu$m, e.g. between about 200 $\mu$m to about 600 $\mu$m. The true density of the particles are preferably between about plus 0.5 $g/cm^3$ to about minus 0.5 $g/cm^3$ of the true density of the liquid phase in which the particles are to be dispersed in. That means that if the liquid phase has a true density of for example 2 $g/cm^3$ the true density of the particle should be between about 1.5 $g/cm^3$ to about 2.5 $g/cm^3$. Of course smaller difference between the true densities of the particles and the liquid phase are better, so preferably the true density of the particles lies between about plus 0.3 $g/cm^3$ to about minus 0.3 $g/cm^3$, e.g. between about 0.1 $g/cm^3$ to about minus 0.1 $g/cm^3$ of the true density of the liquid phase. For small particles, e.g. for sizes between 50 $\mu$m to 200 $\mu$m the difference in true density between the particles and the liquid phase may be bigger depending on the viscosity of the liquid phase. For such small particles true density of the particles may be outside the range of the true density of the liquid plus or minus 0.5 $g/cm^3$. In this embodiment of the invention, particles of a size such as between 50 $\mu$m to 200 $\mu$m may have a true density e.g. in the ranges plus or minus 0.5–1.5 $g/cm^3$ of the true density of the liquid phase.

Wax Matrices

As described, supra, the particle of the invention comprises, in one aspect of the invention, a solid wax matrix wherein an active is distributed. As defined above a wax is a compound, which have a melting point between 20–150° C. Preferred waxes are organic compounds or salts of organic compounds having a melting point in the said range. We have surprisingly found that it is possible, when using a wax matrix as a carrier for the active, to manufacture active particles for which the true density may easily be adjusted and controlled. Also by using a wax matrix we have found that it is possible to obtain particles of a highly controllable and uniform size having a quite narrow particle distribution (cf. the section regarding processes, infra).

The solid wax matrix may be any wax or mixture of waxes suitable for the purpose of incorporating the finished particle in a liquid composition. In the context of the invention the term "wax" as used herein also encompasses mixtures of two or more different waxes. Mixture of different waxes, optionally in combination with heavy and/or light solids are preferred because by mixing waxes of different properties and optionally mixtures of heavy and light solids, particles of a desired true density can be obtained. Accordingly the invention provides a particle comprising a mixture of at least two waxes. Also encompassed by the invention are enzyme particles comprising a mixture of 3, 4 or even 5 waxes.

Also, an important feature of the wax or mixture of waxes is that the wax should be water soluble or water dispersible, preferably in neutral and alkaline solution, so that when the liquid composition of the invention is introduced into an aqueous solution, i.e. by diluting it with water, the solid wax matrix of the particle should disintegrate and/or dissolve providing a quick release and dissolution of the active incorporated in the particles to the aqueous solution. Examples of water soluble waxes are poly ethylene glycols (PEG's) Accordingly amongst water soluble waxes the solubility of wax in water should preferably be up to 75 parts wax to 25 parts water, such as for PEG 1000. Amongst water insoluble waxes which are dispersible in an aqueous solution are triglycerides and oils.

Further a useful wax do not dissolve or disintegrate in a substantially nonaqueous liquid phase. The term "substantially nonaqueous" in this context may be defined as the liquid phase containing little (e.g. below 5% w/w or below 3% w/w) or no water (non-aqueous). Water, if any, present in the nonaqueous liquid of the invention is preferably present due to inclusion of hydrated compounds. The wax should also be compatible with the active, i.e. it should not inactivate the active, e.g. by reacting with the active or permanently altering structures, such as, in case of polypeptides, foldings, helical portions, sheeted portions, prosthetic groups and the like necessary for the active to retain the activity. Still further the wax should be mixable with the active, i.e. the active may be dissolved in the (molten) wax and/or the active may be dispersed in the (molten) wax in an dry particulate form such particles of amorphous and/or crystalline protein, peptide and/or polypeptide. The wax of the invention is in a solid state at room temperature (25° C.), and accordingly is has a melting point or a melting range (polymer waxes tend to melt over a range of temperatures) above this temperature. A preferred wax has a melting point or range between about 35° C. to about 120° C. The lower limit is preferred to set a reasonable distance between the temperature at which the wax melts to the temperature at which liquid compositions comprising the particles are usually stored (20–30° C.). Also, difficulties is contemplated, in the manufacture of the enzyme particles when the melting point of the wax is below 35° C. The upper temperature limit is set as the maximum temperature usually applicable for actives without experiencing significant losses of activity, due to e.g. heat denaturation. A more preferred melting point or range is between about 40° C. to about 100° C., such as between about 50° C. to about 80° C. In a specific embodiment the true density of the wax itself between about plus 0.5 g/cm$^3$ to about minus 0.5 g/cm$^3$ of the true density of the liquid in which the finished particle is to be dispersed, preferably between about plus 0.3 g/cm$^3$ to about minus 0.3 g/cm$^3$, e.g. between about 0.1 g/cm$^3$ to about minus 0.1 g/cm$^3$. In itself the true density of the wax or mixture of waxes is preferably lower than 1.4 g/cm$^3$, more preferably lower than 1.2 g/cm$^3$, most preferably lower than 1.1 g/cm$^3$ However, as described, supra, the true density of the finished particle is important, and accordingly the true density of the wax may be considerably higher or lower than the liquid phase if the particles are small, such as between 50–200 $\mu$m, or other components which may be comprised in the particle compensate to adjust the true density of the particles.

In a further preferred embodiment the wax of the invention have a molecular weight between about 150 Daltons to about 10.000 Daltons.

The wax of the invention may be any wax, which is chemically synthesized. It may also equally well be a wax isolated from a natural source or a derivative thereof. Accordingly in the wax of the invention is preferably selected from the following non limiting list of waxes.

Poly ethylene glycols, abbreviated PEG, type of wax. Different PEG waxes are commercially available having different molecular sizes, wherein PEG's with low molecular sizes also have the lowes melting points. Examples of suitable PEG's are PEG 1500, PEG 3000, PEG 4000, PEG 6000, PEG 9000 e.g. from BASF—Germany. To meet the desired properties of true density and melting point for the wax and/or the enzyme particle, it also contemplated that mixtures of waxes with low melting point with waxes of a high melting point is a very useful embodiment of the invention.

polypropylens or polyethylens or mixtures thereof.

Nonionic tensides which are solid at room temperature such as ethoxylated fatty alcohols having a high level of ethoxy groups such as Lutensol AT80 from BASF having 80 units of ehtyleneoxide per molecule. Alternatively polymers of ethyleneoxide, propyleneoxide or copolymers thereof are useful, such as in block polymers, e.g. Pluronic PE 6800 from BASF Germany.

Waxes isolated from a natural source, such as Carnauba wax (melting point between 80–88° C.), Candelilla wax (melting point between 68–70° C.) and bees wax. Other natural waxes or derivatives thereof are waxes derived from animals or plants, e.g. of marine origin. Examples of such waxes are hydrogenated ox tallow, hydrogenated palm oil, hydrogenated cotton seeds and/or hydrogenated soy bean oil, wherein the term "hydrogenated" as used herein is to be construed as saturation of unsaturated carbohydrate chains, e.g. in triglycerides, wherein carbon=carbon double bonds are converted to carbon-carbon single bonds. An example hydrogenated palm oil is commercially available e.g. from Hobum Oele und Fette GmbH—Germany or Deutche Cargill GmbH—Germany.

Fatty acid alcohols, such as the linear long chain fatty acid alcohol NAFOL 1822 ($C_{8,\ 20,\ 22}$) from Condea Chemie GMBH—Germany, having a melting point between 55–60° C. and having a true density of about 0.96 g/cm$^3$.

Mono-glycerider and/or di-glycerider, such as glyceryl stearate, wherein stearate is a mixture of stearic and palmitic acid are useful waxes. An example of this is Dimodan PM—from Danisco Ingredients, Denmark—having a true density of about 1 g/cm$^3$ Fatty acids, such as hydrogenated linear long chained fatty acids.

Paraffines, i.e. solid hydrocarbons.

Micro-crystalline wax.

In further embodiments waxes which are useful in the invention can be found in C. M. McTaggart et. al., Int. J. Pharm. 19, 139 (1984) or Flanders et. al., Drug Dev. Ind. Pharm. 13, 1001 (1987) both incorporated herein by reference.

As defined, supra, the amount of wax in an un-coated enzyme containing particle is at least 35% w/w in order for the wax to constitute a solid matrix as well as secure suitable pumping and atomization properties (cf. below). However, a preferred amount of wax is at least 50% w/w such as at least 75% w/w.

Actives

The active of the invention may any active component or mixture of active components which benefits from being separated from the liquid phase of a liquid composition. The term "active" is meant to encompass all components which upon release from the wax matrix upon applying the composition or particle of the invention in a process serves a purpose of improving the process. Suitable actives are those which are either subjects of deactivation and/or causing deactivation to other components in the compositions of the invention. As said the active is preferably present dispersed as discrete solid particles in the solid wax matrix. Providing the active in solid for instead of dissolved in the wax may provide more freedom to choose different waxes and it may also provide improved stability of the active.

The active may be inorganic of nature such as bleach components as mentioned infra or organic. Preferred actives are active biological materials which are usually very sensitive to the surrounding environment, such as materials obtainable from microorganisms. Most preferred actives are peptides or polypetides such as enzymes.

The enzyme in the context of the present invention may be any enzyme or combination of different enzymes, which benefits from being incorporated in a particle when comprised in a liquid detergent. Accordingly, when reference is made to "an enzyme" this will in general be understood to include combinations of one or more enzymes.

It is to be understood that enzyme variants (produced, for example, by recombinant techniques) are included within the meaning of the term "enzyme". Examples of such enzyme variants are disclosed, e.g., in EP 251,446 (Genencor), WO 91/00345 (Novo Nordisk), EP 525,610 (Solvay) and WO 94/02618 (Gist-Brocades NV).

The enzyme classification employed in the present specification with claims is in accordance with *Recommendations*

(1992) *of the Nomenclature Committee of the International Union of Biochemistry and Molecular Biology*, Academic Press, Inc., 1992.

Accordingly the types of enzymes which may appropriately be incorporated in granules of the invention include oxidoreductases (EC 1.-.-.-), transferases (EC 2.-.-.-), hydrolases (EC 3.-.-.-), lyases (EC 4.-.-.-), isomerases (EC 5.-.-.-) and ligases (EC 6.-.-.-).

Preferred oxidoreductases in the context of the invention are peroxidases (EC 1.11.1), laccases (EC 1.10.3.2) and glucose oxidases (EC 1.1.3.4)]. An Example of a commercially available oxidoreductase (EC 1.-.-.-) is Gluzyme™ (enzyme available from Novo Nordisk A/S). Further oxidoreductases are available from other suppliers. Preferred transferases are transferases in any of the following subclasses:

a) Transferases transferring one-carbon groups (EC 2.1);

b) transferases transferring aldehyde or ketone residues (EC 2.2); acyltransferases (EC 2.3);

c) glycosyltransferases (EC 2.4);

d) transferases transferring alkyl or aryl groups, other that methyl groups (EC 2.5); and e) transferases transferring nitrogeneous groups (EC 2.6).

A most preferred type of transferase in the context of the invention is a transglutaminase (protein-glutamine γ-glutamyltransferase; EC 2.3.2.13).

Further examples of suitable transglutaminases are described in WO 96/06931 (Novo Nordisk A/S).

Preferred hydrolases in the context of the invention are: Carboxylic ester hydrolases (EC 3.1.1.-) such as lipases (EC 3.1.1.3); phytases (EC 3.1.3.-), e.g. 3-phytases (EC 3.1.3.8) and 6-phytases (EC 3.1.3.26); glycosidases (EC 3.2, which fall within a group denoted herein as "carbohydrases"), such as α-amylases (EC 3.2.1.1); peptidases (EC 3.4, also known as proteases); and other carbonyl hydrolases].

In the present context, the term "carbohydrase" is used to denote not only enzymes capable of breaking down carbohydrate chains (e.g. starches or cellulose) of especially five- and six-membered ring structures (i.e. glycosidases, EC 3.2), but also enzymes capable of isomerizing carbohydrates, e.g. six-membered ring structures such as D-glucose to five-membered ring structures such as D-fructose.

Carbohydrases of relevance include the following (EC numbers in parentheses): α-amylases (EC 3.2.1.1), β-amylases (EC 3.2.1.2), glucan 1,4-α-glucosidases (EC 3.2.1.3), endo-1,4-beta-glucanase (cellulases, EC 3.2.1.4), endo-1,3(4)-β-glucanases (EC 3.2.1.6), endo-1,4-β-xylanases (EC 3.2.1.8), dextranases (EC 3.2.1.11), chitinases (EC 3.2.1.14), polygalacturonases (EC 3.2.1.15), lysozymes (EC 3.2.1.17), β-glucosidases (EC 3.2.1.21), α-galactosidases (EC 3.2.1.22), β-galactosidases (EC 3.2.1.23), amylo-1,6-glucosidases (EC 3.2.1.33), xylan 1,4-β-xylosidases (EC 3.2.1.37), glucan endo-1,3-β-D-glucosidases (EC 3.2.1.39), α-dextrin endo-1,6-α-glucosidases (EC3.2.1.41), sucrose α-glucosidases (EC 3.2.1.48), glucan endo-1,3-α-glucosidases (EC 3.2.1.59), glucan 1,4-β-glucosidases (EC 3.2.1.74), glucan endo-1,6-β-glucosidases (EC 3.2.1.75), arabinan endo-1,5-α-L-arabinosidases (EC 3.2.1.99), lactases (EC 3.2.1.108), chitosanases (EC 3.2.1.132) and xylose isomerases (EC 5.3.1.5).

Examples of commercially available proteases (peptidases) include Kannase™, Everlase™, Esperase™, Alcalase™, Neutrase™, Durazym™, Savinase™, Pyrase™, Pancreatic Trypsin NOVO (PTN), Bio-Feed™ Pro and Clear-Lens™ Pro (all available from Novo Nordisk A/S, Bagsvaerd, Denmark).

Other commercially available proteases include Maxatase™, Maxacal™, Maxapem™, Opticlean™ and Purafect™ (available from Genencor International Inc. or Gist-Brocades).

Examples of commercially available lipases include Lipoprime™ Lipolase™, Lipolase™ Ultra, Lipozyme™, Palatase™, Novozym™ 435 and Lecitase™ (all available from Novo Nordisk A/S).

Other commercially available lipases include Lumafast™ (*Pseudomonas mendocina* lipase from Genencor International Inc.); Lipomax™ (*Ps. pseudoalcaligenes* lipase from Gist-Brocades/Genencor Int. Inc.; and Bacillus sp. lipase from Solvay enzymes. Further lipases are available from other suppliers.

Examples of commercially available carbohydrases include Alpha-Gal™, Bio-Feed™ Alpha, Bio-Feed™ Beta, Bio-Feed™ Plus, Bio-Feed™ Plus, Novozyme™ 188, Celluclast™, Cellusoft™, Ceremyl™, Citrozym™, Denimax™, Dezyme™, Dextrozyme™, Finizym™, Fungamyl™, Gamanase™, Glucanex™, Lactozym™, Maltogenase™, Pentopan™, Pectinex™, Promozyme™, Pulpzyme™, Novamyl™, Termamyl™, AMG™ (Amyloglucosidase Novo), Maltogenase™, Sweetzyme™ and Aquazym™ (all available from Novo Nordisk A/S). Further carbohydrases are available from other suppliers.

The content of enzyme (calculated as pure enzyme protein) in a particle of the invention will typically be in the range of from about 0.05% to 50% by weight of the enzyme-containing particle.

When, for example, a protease (peptidase) is incorporated in particles according to the invention, the enzyme activity (proteolytic activity) of the finished granules will typically be in the range of 1–20 KNPU/g. This unit for protease activity is Kilo Novo Protease Units per gram of sample (KNPU/g). The activity is determined relatively to an enzyme standard of known activity in KNPU/g. The enzyme standard is standardized by measuring for a given amount of enzyme the formation rate (μmol/minute) of free amino groups liberated from digestion of di-methyl-casein (DMC) in solution by the enzyme. The formation rate is monitored by recording the linear development of absorbance at 420 nm of the simultaneous reaction between the formed free amino groups and added 2,4,6-tri-nitro-benzene-sulfonic acid (TNBS). The digestion of DMC and the color reaction is carried out at 50° C. in a pH 8.3 boric acid buffer with a 9 min. reaction time followed by a 3 min. measuring time. A folder AF 220/1 is available upon request to Novo Nordisk A/S, Denmark, which folder is hereby included by reference.

Likewise, in the case of, for example, α-amylases, an activity of 10–500 KNU/g will be typical. The activity is determined relatively to an enzyme standard of known activity in KNU/g. The enzyme standard is standardized by measuring for a given amount of enzyme the formation rate (μmol/minute) of 2-chlor-4-nitrophenol liberated from digestion of 2-chlor-4-nitrophenyl-b-D-maltoheptaosid substrate by the enzyme and auxiliary alfa- and beta-glucosidase enzymes in solution. Kits for performing α-amylase assays are commercially available. One description of an α-amylase assay may be found in the leaflet AF318/1-GB available upon request from Novo Nordisk A/S, Denmark. For e.g. lipases, an activity in the range of 50–400 KLU/g will normally be suitable.

Other Components

The particles of the invention may, as said, also contain one or more other components, which is different from the active and the wax. These components should preferably also be dispersible or soluble in aqueous solution at neutral or alkaline pH. The term "different" as used in this context is to be understood as a component is not identical to the active nor to the wax. Other components may be divided into components which are used to modify the true density of the particle (herein denoted a "density modifier") and components which provides other properties to the particle.

Density Modifiers

Density modifiers as used herein is defined as components which has a lower or higher true density than the wax matrix. The density modifier is preferably a solid or a gas dispersed in the wax matrix.

A preferred density modifier is a light component useful for lowering the true density of the particle of the invention.

A light component have a true density lower than the true density of the solid wax matrix thus enabling adjustment of the true density of the finished particle. In a specific embodiment the true density of the light component is at least 0.2 g/cm$^3$ lower than the true density of the solid wax matrix incorporating the enzyme, preferably at least 0.4 g/cm$^3$ lower, e.g. at least 0.6 g/cm$^3$ lower than the solid wax matrix incorporating the enzyme. Light weight components may be selected from following non-limiting list:

- Light spheres, which are small particles with low true density. Typically, they are hollow spherical particles with air or gas inside. Such material are usually prepared by expanding a solid material. These light spheres may be inorganic of nature such as Scotchlite™ Glass Bubbles from 3M™ (hollow glass spheres), Q-CEL® (hollow microspheres of borosilicate glass) and/or Extendospheres® (ceramic hollow spheres) available from The PQ Corporation. The light spheres may also be of organic nature such as the PM-series (plastic hollow spheres) available from The PQ Corporation. Expancel® (hollow plastic spheres) from AKZO Nobel, Luxsil® and Sphericel® from Potters Industries and/or Styrocell® from SHELL, which is spheres of polystyrene. The polystyrene of Styrocell® contains pentane which upon heating boils and expands or pops the material (the reaction is comparable to the expansion of corn seeds into popcorn) leaving a light polystyrene material of a low true density. Also polysaccharides are preferred, such as starch or derivatives thereof. Biodac® is an example of non-hollow light weight material made from cellulose (waste from papermaking), available from GranTek Inc. These materials may be included in the granules of the invention either alone or as a mixture of different light materials. Usually only small amounts of light material is needed, so that a useful level of gas in the enzyme particle is below 10% w/w of the finished particle, preferably below 5% w/w, more preferably below 3% w/w e.g. about 0.1–1% w/w.
- Gases, such as atmospheric air (preferred) or other gases, e.g. nitrogen. A gas may be introduced and confined into the wax matrix during the solidification of the wax, e.g. in the form of small bubbles, thereby reducing the true density of the finished enzyme particle. Usually only a little gas is needed, so that a useful level of gas in the enzyme particle is below 5% w/w of the finished particle, preferably below 3% w/w, more preferably below 1% w/w e.g. about 0.1% w/w.

In another preferred embodiment the density modifier is a heavy component useful for adjusting the true density of the particle of the invention. A heavy component have a true density higher than the true density of the solid wax matrix incorporating the enzyme thus enabling adjustment of the true density of the finished enzyme particle. In a specific embodiment the true density of the light material is at least 0.2 g/cm$^3$ higher than that of the solid wax matrix incorporating the enzyme, preferably at least 0.4 g/cm$^3$ higher, e.g. at least 0.6 g/cm$^3$ higher than the solid wax matrix incorporating the enzyme. Heavy material may be selected from following non-limiting list:

- Water soluble and/or insoluble inorganic materials such as salts, especially alkali salts e.g. finely ground alkali sulphate (anhydrous $Na_2SO_4$ has a true density of about 2.7 g/cm$^3$), alkali carbonate and/or alkali chloride); clays such as kaolin (e.g. Speswhite™, English China Clay); bentonites; talcs; zeolites and/or silicates is useful.

Components Providing Other Properties of the Particle

Other optional components which may suitably be incorporated in the particle may be selected from following non-limiting list:

- Stabilizing and/or protecting agents. Stabilizing or protective agents may fall into several categories: alkaline or neutral materials, reducing agents, antioxidants and/or salts of first transition series metal ions. Each of these may be used in conjunction with other protective agents of the same or different categories. Examples of alkaline protective agents are alkali metal silicates, carbonates or bicarbonates which provide a chemical scavenging effect by actively neutralizing e.g. oxidants. Examples of reducing protective agents are salts of sulfite, thiosulfite or thiosulfate, while examples of antioxidants are ascorbic acid, methionine, butylated hydroxytoluene (BHT) or butylated hydroxyanisol (BHA). Most preferred agents are salts of thiosulfates, e.g. sodium thiosulfate. Useful enzyme stabilizers, especially for protease enzymes, may be borates, borax, formates, di- and tricarboxylic acids and reversible enzyme inhibitors such as organic compounds with sulfhydryl groups or alkylated or arylated boric acids. Examples of boron based stabilizer may be found in WO 96/21716, whereas a preferred boron based stabilizer is 4-Formyl-Phenyl-Boronic Acid or derivatives thereof described in WO 96/41859 both disclosured incorporated herein by reference. Still other examples of useful enzyme stabilizers are gelatine, casein, Poly vinyl pyrrolidone (PVP) and powder of skimmed milk.
- Enzyme activators and cofactors which may be used in the washing process to activate or enhance the action of the enzyme. Various organic enhancers or activators acting as electron donors for oxidoreductase enzymes for various purposes, such as bleaching or antimicrobial action are known to the art (e.g. from WO 94/12620, WO 94/12621, WO 95/01626 and WO 96/00179) and may suitably be incorporated in the enzyme particle. One group of preferred organic enhancers is phenolic compounds (alkylsyringates) of the formula:

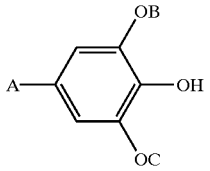

wherein the letter A in said formula denotes be a group such as —D, —CH═CH—D, —CH═CH—CH═CH—D, —CH═N—D, —N═N—D, or —N═CH—D, in which D is selected from the group consisting of —CO—E, —$SO_2$—E, —N—XY, and —N+—XYZ, in which E may be —H, —OH, —R, or —OR, and X and Y and Z may be identical or different and selected from —H and —R; R being a $C_1$–$C_{16}$ alkyl, preferably a $C_1$–$C_8$ alkyl, which alkyl may be saturated or unsaturated, branched or unbranched and optionally substituted with a carboxy, sulpho or amino group; and B and C may be the same or different and selected from $C_mH_{2m+1}$, where m=1, 2, 3, 4 or 5. In the above mentioned formula A may be placed meta to the hydroxy group instead of being placed in the para-position as shown.

In particular embodiments of the invention the enzyme activator or enhancer is selected from the group having the formula:

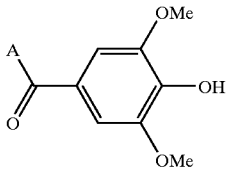

in which A is a group such as —H, —OH, —$CH_3$, —$OCH_3$, —$O(CH_2)_nCH_3$, where n=1, 2, 3, 4, 5, 6, 7 or 8.

Another preferred group of well performing organic enzyme activators or enhancers comprises a —CO—NOH— group and have the following formula:

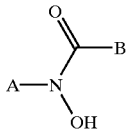

in which A is:

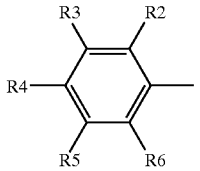

and B is the same as A, or B is H, or C1–C16 branched or unbranched alkyl wherein said alkyl may contain hydroxy, ether or ester groups, and R2, R3, R4, R5 and R6 are H, OH, NH2, COOH, SO3H, C1–C12 branched or unbranched alkyl, acyl, NO2, CN, Cl, CF3, NOH—CO-phenyl, C1–C6-CO—NOH—A, CO—NOH—-A, COR12, phenyl-CO—NOH—A, OR7, NR8R9, COOR10, or NOH—CO—R11, wherein R7, R8, R9, R10 and R11 are C1–C12 branched or unbranched alkyl or acyl. Whitin this group of enhancers particularly preferred enhancers are selected from the group consisting of
4-nitrobenzoic acid-N-hydroxyanilide;
4-methoxybenzoic acid-N-hydroxyanilide;
N,N'-dihydroxy-N,N'-diphenylterephthalamide;
decanoic acid-N-hydroxyanilide;
N-hydroxy-4-cyanoacetanilide;
N-hydroxy-4-acetylacetanilide;
N-hydroxy-4-hydroxyacetanilide;
N-hydroxy-3-(N'-hydroxyacetamide)acetanilide;
4-cyanobenzoic acid-N-hydroxyanilide;
N-hydroxy-4-nitroacetanilide; and
N-hydroxyacetanilide.

Inorganic enzyme activators enhancers may also be relevant. Especially presence of inorganic halide ions such as chloride, bromide and/or iodide may enhance the antimicrobial effect of a haloperoxidase.

Dispersants for providing stability of an active suspension in a molten wax.

viscosifiers for proving a suitable viscosity, enabling optimum pumping and/or atomization properties.

Inert fillers.

Pigments such as organic pigments or inorganic e.g. $TiO_2$

Coatings

To lower formation of active dust from the particles of the invention, when handling the particles in a dry solid form, the particles may suitably be coated with one or more coating layers surrounding the solid wax matrix comprising the active, which also may provide additional protection of the active from components in the surrounding environment, e.g. liquid phase. Accordingly the invention also provides particles of the invention coated with one or more coating layers surrounding the solid wax matrix. For lowering formation of dust, the coating is preferably substantially free of active, e.g. the coating contains less than 6 milligram active, such as enzyme per gram coating. However, one or more layers of coating which may comprise additional actives may be applied between the wax matrix particle and the outer coating layer. Useful coatings for particles of the invention are described in the art, such as in the international patent application DK99/00364 (unpublished) In a preferred embodiment the coating also comprises a wax such as described, supra.

It is only necessary for the coating to be intact when handling the enzyme particles in dry form, because when the particles is added to a the liquid phase active dust formation from the particles is eliminated. Accordingly coating materials may be chosen which is soluble or dispersible in the liquid phase of the liquid composition. In one preferred embodiment the coating material is insoluble or indispersible in the liquid phase of the liquid composition and in a second preferred embodiment the coating material is soluble or dispersible in the liquid phase of the liquid composition. The coating may be applied by conventional coating methods e.g. in a mixer granulator or a fluid bed e.g. by spraying the coating material or a solution or dispersion thereof onto the particles of the invention.

Processes for Manufacturing Enzyme Particles

The invention also relates to processes for preparing particles of the invention.

We have found a process for preparing particles of the invention wherein the true density of the finished particles may be adjusted to a desired value. The process comprises the steps of:

(a) Preparing a mixture, I, comprising a first wax, preferably in a molten form, and one or more additional waxes, preferably in a molten form, having a lower or higher true density than the first wax or (b) preparing a mixture, II, comprising a first wax, preferably in a molten form and a density modifier or (c) preparing a mixture, III, comprising a first wax, preferably in a molten form, and one or more additional waxes, preferably in a molten form, having a lower or higher true density than the first wax and a density modifier, (d) dispersing or dissolving an active in mixtures I or II or (e) preparing active containing particles by solidifying the dispersion or solution obtained in step (d).

In one embodiment a process comprising step (a) is preferred while in a further embodiment a process comprising step (b) is preferred, while in a still further embodiment a process comprising step (c) is preferred. The invention also encompasses products obtainable by a process comprising steps (a), (d) and (e) or (b), (d) and (e) or (c), (d) and (e).

Actives, waxes and density modifiers are described supra.

The process step (e) are preferably performed in a so-called spray-cooling or spray-chilling process as known to the art, comprising the steps of:

(f) atomizing the dispersion or solution into droplets and (g) solidifying the droplets into solid particles by cooling the droplets, and this process may also preferably be followed by one or more cooling steps (FIG. 1F) and optionally fractionating and recycling (FIGS. 1H and I) steps.

The active may be applied to the molten wax by mixing a preferably purified solid active into the molten wax. In the preferred embodiment of the active being an enzyme, the enzyme is preferably a crystalline or amorphous enzyme preparation (such as described in WO 91/09943). In a more preferred embodiment the active and optionally other components are in a dry powder form such as spray dried products, which is dispersed or suspended in the molten wax. Atomization of the molten wax may be achieved in a number of way, where amongst it is preferred to perform the atomization using either a high speed rotating disk atomizer, a pressure nozzle, a pneumatic nozzle or a sonic nozzle such as described in the Course Material from the Microencapsulation Seminar, held by Center for professional advancement on May 9 to May 11, 1990 in Amsterdam. The solidification of the droplets by cooling may advantageously be performed in a cooling container such as a tower, wherein the atomized dispersion or solution of enzyme in molten wax is introduced into a cold air stream in the top of the tower, and the solidification of the droplets occurs while the droplets passes through the cold air stream towards the bottom of the tower. The mixture of molten wax, enzyme and optionally other components is preferably fed to the atomizer at a temperature at least 30° C. above the temperature at which the solidification commences, in order to avoid unintended solidification and blockage in feed pipes and atomizer. The quantity and temperature of air used for cooling the molten wax mixture should be adjusted so that is able of removing sufficient heat from the molten wax mixture to enable solidification (sensible heat of the liquid, latent heat of fusion of the solid and sensible heat of the solid). In a preferred embodiment the temperature of air leaving the cooling tower (FIG. 1D) is about 5° C. below the temperature of solid particles leaving the cooling tower.

The general technique of spray cooling or spray chilling is well known to the art, and may be performed using well known equipment such as described in K. Masters, Applications in the chemical industry, section 14.10.1, pp 565–566, Spray drying Handbook, 3'edition 1979 George Goodwin Ldt. London ISBN 0-7114-4924-4/John Wiley & Sons, New York. A schematic overview of a spray cooling process is depicted in FIG. 1.

By applying spray cooling in the preparation of the particle of the invention very spherical particles may be achieved of a size, which may be adjusted by adjusting the atomization and cooling conditions. Useful particle sizes lies within the range of about 20 μm to about 2000 μm, preferably between about 100 μm to about 1000 μm, e.g. between about 200 μm to about 600 μm. Once the atomization and cooling conditions are determined particles with a narrow size distribution may be prepared, lowering the need for separating, e.g. by sieving, and recycling over- and undersized particles. In a preferred embodiment the particles have, prior to a sieving and/or recycling step, a SPAN value below about 2.0 preferably below about 1.2, more preferably below about 1.0, more preferably below about 0.8 and most preferably below about 0.6.

The SPAN value is a measure of the breadth the particle size distribution (PSD) and is defined as:

(D90-D10)/D50 wherein the D values expresses the mass mean diameter of the individual particles. The mean mass diameter, D50, is the diameter at which 50% of the enzyme particles, by mass, have a smaller diameter, while 50% by mass have a larger diameter. The values D10 and D90 are the diameters at which 10% and 90%, respectively, of the particles, by mass, have a smaller diameter than the -value in question. The smaller the SPAN value is, the narrower the particle size distribution is.

For purposes of the present invention, the particle size distribution is normally as narrow as possible. The span of a granulate product according to the invention is therefore typically not more than about 2.5, preferably not more than about 2.0, more preferably not more than about 1.5, and most preferably not more than about 1.0.

As an alternative the invention also encompasses the preferred process of particles being prepared by making a dispersion of active and optionally other components in one or more molten waxes, letting the wax(es) solidify and milling/crushing the solid wax matrix into particles and optionally rounding the particles, e.g. in a Marumerizer, before optionally coating the particles.

Coating Methods

Coating of the prepared enzyme containing particles may be achieved by any conventional coating method, such as in a fluid bed coater, the process comprising:

(a) fluidising the particle of the invention in a fluid bed apparatus, (b) introducing a liquid medium comprising a coating material to the particles of the invention by atomization of the liquid medium into the fluid bed, so as to deposit the coating material as a solid coating layer on the particles of the invention and, (c) removing volatile components of the liquid medium from the coated particles.

Liquid Compositions

The invention also relates to a liquid composition comprising dispersed herein solid particles of the invention, as described supra. Also encompassed by the invention is a process for preparing a liquid composition comprising the step of dispersing solid particles of the invention in a liquid phase.

The liquid phase of the composition is in a liquid form at 20° C. Preferably the particles of the invention is substantially-stably dispersed in the liquid phase of the composition.

For purposes of the invention the term "substantial stable dispersion" of particles in a liquid composition is defined as a dispersion wherein separation of the particles from the liquid phase, whereby the particles concentrates in a portion of the composition cannot be visually observed on a sample of the dispersion kept at 20° C. for at least 48 hours. In a more restricted and preferred definition a separation of separation of the enzyme particles from the liquid phase cannot be observed on a sample of the dispersion kept at 20° C. for at least one, more preferably two weeks.

In a preferred embodiment of the invention the active in the particle is an enzyme and the liquid composition is a liquid detergent composition. In order for an enzyme particle to stay dispersed in a liquid detergent phase one important property of the particle is its true density. If the enzyme particle have a true density which significantly exceeds the true density of the liquid detergent phase the enzyme particle will over time not stay dispersed in the liquid detergent phase, but affected by gravitational forces it will move towards the bottom of the liquid phase and form an enzyme particle sediment. If however the true density of the enzyme particles is significantly less than the true density of the liquid detergent phase the enzyme particles will concentrate at the surface. It is contemplated, that these movements are of course dependent of the viscosity of the liquid phase in which the particles are dispersed and the size of the particles, i.e. the higher the viscosity of the liquid phase and the lower the size, the larger the difference in true density between the liquid phase and the enzyme particles may be allowed to keep the enzyme particles dispersed. Accordingly in a preferred embodiment of the invention the liquid detergent composition of the invention comprises enzyme particles, which have a true density between about plus 0.5 g/cm$^3$ to about minus 0.5 g/cm$^3$ of the true density of the liquid detergent phase. That means that if the detergent has a true density of for example 2 g/cm$^3$ the true density of the enzyme particle should be between about 1.5 g/cm$^3$ to about 2.5 g/cm$^3$. Of course smaller difference between the true densities of the enzyme particles and the liquid phase are better, so preferably the true density of the enzyme particles lies between about plus 0.3 g/cm$^3$ to about minus 0.3 g/cm$^3$, e.g. between about 0.1 g/cm$^3$ to about minus 0.1 g/cm$^3$ of the true density of the liquid detergent phase. For small enzyme containing particles, e.g. for sizes between 50 $\mu$m to 200 $\mu$m the difference in true density between the enzyme particles and the liquid phase may be bigger depending on the viscosity of the liquid phase. For such small particles true density of the particles may be outside the range of the true density of the liquid plus or minus 0.5 g/cm$^3$. In this embodiment of the invention, particles of a size such as between 50 $\mu$m to 200 $\mu$m may have a true density e.g. in the ranges plus or minus 0.5–1.5 g/cm$^3$ of the true density of the liquid phase.

The desire and need for enzyme particles of a highly controlled true density, which enables formation of substantially stabile dispersions of enzyme particles in a liquid detergent phase has encouraged us to develop the liquid detergent composition of the invention.

Liquid detergents

The liquid detergent composition of the invention is preferably substantially non-aqueous (or anhydrous) in character. The term "substantially non-aqueous" as used in this context means that while very small amounts of water may be incorporated into such preferred compositions as an impurity in the essential or optional components, the amount of water in non-aqueous liquid detergent compositions of the invention should in no event exceed about 5% by weight of the composition. More preferably, water content of the non-aqueous detergent composition will comprise less than about 1% by weight.

Surfactant

The detergent composition of the invention comprises one or more surfactants, which may be non-ionic including semi-polar and/or anionic and/or cationic and/or zwitterionic. The amount of the surfactant mixture component of the detergent compositions herein can vary depending upon the nature and amount of other composition components and depending upon the desired rheological properties of the ultimately formed composition. Generally, this surfactant mixture will be used in an amount comprising from about 0.1% to 90% by weight of the composition. More preferably, the surfactant mixture will comprise from about 10% to 60% by weight of the composition.

When included therein the detergent will usually contain from about 1% to about 40% of an anionic surfactant such as linear alkylbenzenesulfonate, alpha-olefinsulfonate, alkyl sulfate (fatty alcohol sulfate), alcohol ethoxysulfate, secondary alkanesulfonate, alpha-sulfo fatty acid methyl ester, alkyl- or alkenylsuccinic acid or soap. Highly anionic preferred surfactants are the linear alkyl benzene sulfonate (LAS) materials. Such surfactants and their preparation are described for example in U.S. Pat. Nos. 2,220,099 and 2,477,383, incorporated herein by reference. Especially preferred are the sodium and potassium linear straight chain alkylbenzene sulfonates in which the average number of carbon atoms in the aikyi group is from about 11 to 14. Sodium $C_{11}$–$C_{14}$, e.g., $C_{12}$, LAS is especially preferred. Other useful anionic surfactants are described in WO 99/0478, pages 11 through 13, incorporated herein by reference.

When included therein the detergent will usually contain from about 0.2% to about 40% of a non-ionic surfactant such as alcohol ethoxylate, nonylphenol ethoxylate, alkylpolyglycoside, alkyldimethylamineoxide, ethoxylated fatty acid monoethanolamide, fatty acid monoethanolamide, polyhydroxy alkyl fatty acid amide, or N-acyl N-alkyl derivatives of glucosamine ("glucamides"). Such useful non-ionic surfactants are further described in WO 99/0478, pages 13 through 14, incorporated herein by reference.

The detergent may also contain ampholytic and/or zwitterionic surfactants.

A typical listing of anionic, non-ionic, ampholytic and zwitterionic surfactants is given in U.S. Pat. No. 3,664,961 issued to Norris on May 23, 1972.

Non-aqueous Liquid Diluent

To form the liquid phase of the detergent compositions, the hereinbefore described surfactant (mixture) may be combined with a nonaqueous liquid diluent such as a liquid alcohol alkoxylate material or a nonaqueous, low-polarity organic solvent such as described in WO 99/0478, pages 14 through 17, incorporated herein by reference. A non-aqueous, low-polarity organic solvent(s) employed should, of course, be compatible and non-reactive with other composition components, e.g., Enzymes and/or bleach and/or activators, used in the liquid detergent compositions herein.

Such a solvent component will generally be utilized in an amount of from about 1% to 60% by weight of the composition. More preferably, the non-aqueous, low-polarity organic solvent will comprise from about 5% to 40% by weight of the composition, most preferably from about 10% to 25% by weight of the composition.

EDDS

The compositions of the invention may contain from about 0.01% to about 10%, preferably from about 0.05% to about 2%, of ethylenediamine-N,N'-disuccinic acid (EDDS) or the alkali metal, alkaline earth metal, ammonium, or substituted ammonium salts thereof, or mixtures thereof. Preferred EDDS compounds for liquid detergent compositions are the free acid form and sodium sodium or potassium salts thereof. EDDS are described in U.S. Pat. No. 4,704,233.

EDDS improves the efficiency of enzymes, especially amylases, in liquid non-aqueous detergent compositions upon dilution in the wash liquor. Without being bound by theory, it is believed that ethylenediamine-N,N'-disuccinic acid or its salts act to bind heavy metal ions thereby preventing that heavy metal ions bind at the active site of the enzyme. The binding of heavy metal ions at the active site of the enzyme results in generation of OH free radicals within the enzyme, resulting in destruction of the enzyme.

Chelating Agents

The liquid detergent compositions according to the present invention may also contain 0–65% w/w other chelating agents. Such chelating agents can be selected from the group consisting of amino carboxylates, amino phosphonates, polyfunctionally-substituted aromatic chelating agents, diphosphate, triphosphate, carbonate, citrate, nitrilotriacetic acid, ethylenediaminetetraacetic acid, diethylenetriaminepentaacetic acid, alkyl- or alkenylsuccinic acid, soluble silicates or layered silicates (e.g. SKS-6 from Hoechst) and mixtures thereof. Further chelating agents are described in WO 99/00478 incorporated herein by reference.

Enzyme stabilizers

The enzyme(s) in the particles of the invention may be also be stabilized conventionally using stabilizing agents in the liquid phase, e.g., a polyol such as propylene glycol or glycerol, a sugar or sugar alcohol, lactic acid, boric acid, or a boric acid derivative, e.g., an aromatic borate ester, or a phenyl boronic acid derivative such as 4-formylphenyl boronic acid, and the composition may be formulated as described in e.g. WO 92/19709 and WO 92/19708.

It is at present contemplated that in the detergent compositions any enzyme, in particular the enzyme of the invention, may be added in an amount corresponding to 0.01–100 mg of enzyme protein per liter of wash liquor, preferably 0.05–5 mg of enzyme protein per liter of wash liquor, in particular 0.1–1 mg of enzyme protein per liter of wash liquor.

The enzyme of the invention may additionally be incorporated in the detergent formulations disclosed in WO 97/07202 which is hereby incorporated as reference.

Particulate Material Other Than Enzyme Particles

The liquid detergent compositions of the invention may besides from the enzyme particles of the invention further comprise a solid phase of particulate material which is dispersed and suspended within the liquid phase. Generally such particulate material will range in size from about 0.1 to 1500 $\mu$m. More preferably such material will range in size from about 5 to 500 $\mu$m.

The particulate material utilized herein can comprise one or more types of detergent composition components which in particulate form are substantially insoluble in the liquid phase of the composition. The types of particulate materials which can be utilized may be selected from the following non-limiting list of useful components

- Solid peroxygen bleaching agent. The most preferred type of particulate material useful for forming the solid phase of the detergent compositions herein comprises particles of a peroxygen bleaching agent. Such peroxygen bleaching agents may be organic or inorganic in nature. Inorganic peroxygen bleaching agents are frequently utilized in combination with a bleach activator. Useful inorganic peroxygen bleaching agents include perborate or percarbonate compounds. Useful organic peroxygen bleaching agents include percarboxylic acid bleaching agents and/or peroxyacids of e.g. the amide, imide, or sulfone type. Suitable examples of peroxygen bleaching agent are further described in WO 99/00478 pages 18–19 incorporated herein by reference. If peroxygen bleaching agents are used as all or part of the essentially present particulate material, they will generally comprise from about 1% to 30% by weight of the composition. More preferably, peroxygen bleaching agent will comprise from about 1% to 20% by weight of the composition. Most preferably, peroxygen bleaching agent will be present to the extent of from about 3% to 15% by weight of the composition.
- Solid bleach activators, such as a peracid-forming bleach activator e.g. tetraacetylethylenediamine or nonanoyloxybenzenesulfonate. Suitable examples of bleach activators are further described in WO 99/00478 pages 19–20 incorporated herein by reference. If utilized, bleach activators can comprise from about 0.5% to 20%, more preferably from about 1% to 10%, by weight of the composition. Frequently, activators are employed such that the molar ratio of bleaching agent to activator ranges from about 1:1 to 10:1, more preferably from about 1.5:1 to 5:1. In addition, it has been found that bleach activators, when agglomerated with certain acids such as citric acid, are more chemically stable.
- Particulate surfactants, which can be suspended in the e.g. non-aqueous liquid detergent compositions herein includes ancillary anionic surfactants which are fully or partially insoluble in the non-aqueous liquid phase. The most common type of anionic surfactant with such solubility properties comprises primary or secondary alkyl sulfate anionic surfactants. Such surfactants are those produced by the sulfation of higher $C_8$–$C_{20}$ fatty alcohols. Further examples of such useful surfactants are described in WO 99/00478 pages 21–22 incorporated herein by reference. If utilized as all or part of the requisite particulate material, ancillary anionic surfactants such as aikyl sulfates will generally comprise from about 1% to 10% by weight of the composition, more preferably from about 1% to 5% by weight of the composition. Alkyl sulfate used as all or part of the particulate material is prepared and added to the compositions herein separately from the unalkoxylated alkyl sulfate material which may form part of the alkyl ether sulfate surfactant component essentially utilized as part of the liquid phase herein.
- Solid organic builder material. Such compounds serves to counteract the effects of calcium, or other ion, water hardness encountered during laundering and/or bleaching use of the compositions herein. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred. Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark. Another suitable type of organic builder comprises the water-soluble salts of higher fatty acids, i.e., "soaps". These include alkali metal soaps such as the sodium, potassium, ammonium, and alkyloammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap. If utilized as all or part of the requisite particulate material, insoluble organic detergent builders can generally comprise from about 1% to 20% by weight of the compositions herein. More preferably, such builder material can comprise from about 4% to 1 0% by weight of the composition.

Solid inorganic alkalinity source compounds may also be incorporated in the detergent composition of the invention. Such compounds can comprise a material which serves to render aqueous washing solutions formed from compositions of the invention generally alkaline in nature. Such materials may or may not also act as detergent builders, i.e., as materials which counteract the adverse effect of water hardness on detergency performance. Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred. The alkalinity source, if in the form of a hydratable salt, may also serve as a desiccant in a non-aqueous liquid detergent composition. The presence of an alkalinity source which is also a desiccant may provide benefits in terms of chemically stabilizing those composition components such as the peroxygen bleaching agent which may be susceptible to deactivation by water. If utilized as all or part of the particulate material component, the alkalinity source compounds will generally comprise from about 1% to 15% by weight of the compositions herein. More preferably, the alkalinity source can comprise from about 2% to 10% by weight of the composition. Such materials, while water-soluble, will generally be insoluble in a non-aqueous detergent composition and such materials will generally be dispersed in a non-aqueous liquid phase in the form of discrete particles.

Optional Detergent Ingredients

The detergent may also contain other optional detergent ingredients. The optional components may either dissolve in the liquid phase or may be dispersed within the liquid phase in the form of fine particles or droplets. The types of materials which can be utilized may be selected from the following non-limiting list of useful components:

Inorganic Detergent Builders. The detergent composition of the invention may also optionally contain one or more types of inorganic detergent builders beyond those listed hereinbefore that also function as alkalinity sources or chelating agents. Such optional inorganic builders can include, for example, aluminosilicates such as zeolites. Aluminosilicate zeolites, and their use as detergent builders are more fully discussed in Corkill et al., U.S. Pat. No. 4,605,509; issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

Thickening, Viscosity Control and/or Dispersing Agents. The detergent composition of the invention may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP), carboxymethylcellulose, poly (ethylene glycol), poly(vinyl alcohol), poly(vinylpyridine-N-oxide), poly (vinylimidazole) and polymeric amine derivatives such as quaternized, ethoxylated hexamethylene diamines. Polymeric polycarboxylate materials can be prepared by polymerising or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid, methylenemalonic acid and lauryl methacrylic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer. Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Dieh~i, U.S. Pat. No. 3,308,067, issued Mar. 7, 1967. Such materials may also perform a builder function. If utilized, the optional thickening, viscosity control and/or dispersing agents should be present in the compositions herein to the extent of from about 0.1% to 4% by weight. More preferably, such materials can comprise from about 0.5% to 2% by weight of the detergents compositions herein.

Optional Brighteners, Suds Suppressers and/or Perfumes. The detergent composition of the invention herein may also optionally contain conventional brighteners, suds suppressers, silicone oils, bleach catalysts, and/or perfume materials. Such brighteners, suds suppressers, silicone oils, bleach catalysts, and perfumes must, of course, be compatible and nonreactive with the other composition components in the environment of the liquid detergent composition. If present, brighteners, suds suppressers and/or perfumes will typically comprise from about 0.01% to 5% by weight of the compositions herein. Suitable bleach catalysts include the manganese based complexes disclosed in U.S. Pat. No. 5,246,621, U.S. Pat. No. 5,244,594, U.S. Pat. No. 5,114,606 and U.S. Pat. No. 5,114,611.

Optional organic additives. The detergent composition of the invention may contain an organic additive. A preferred organic additive is hydrogenated castor oil and its derivatives. Hydrogenated castor oil is a commercially available commodity being sold, for example, in various grades under the trademark CASTOR-WAX.RTM. by NL Industries, Inc., Highstown, N.J. Other suitable hydrogenated castor oil derivatives are Thixcin R, Thixcin E, Thixatrol ST, Perchem R and Perchem ST. Especially preferred hydrogenated castor oil is Thixatrol ST. The castor oil can be added as a mixture with for example stereamide. The organic additive will be partially dissolved in a non-aqueous liquid diluent. To form the structured liquid phase required for suitable phase stability and acceptable rheology, the organic additive is generally present to the extent of from about 0.05% to 20% by weight of the liquid phase. More preferably, the organic additive will comprise from about 0.1% to 10% by weight of liquid phase of the detergents composition of the invention.

Other optional detergent ingredients such as fabric conditioners including clays, foam boosters, anti-corrosion agents, soil-suspending agents, anti-soil redeposition agents, dyes, bactericides, hydrotropes and tarnish inhibitors,

Methods for Preparing Liquid Detergent Compositions

The liquid detergent compositions herein can be prepared by mixing the liquid phase and by thereafter adding to this phase the additional particulate components in any convenient order and by mixing, e.g., agitating, the resulting component combination to form a stable composition. In a typical process for preparing such compositions, essential and certain preferred optional components will be combined in a particular order and under certain conditions. Methods for preparing liquid detergents, including non-aqueous liquid detergents are well known to the art and an example may be found in WO 99/00478 pages 27–32, incorporated herein by reference.

Uses

The invention also relates to the use of a liquid composition of the invention for cleaning an item. The item is preferably a cellulose containing fabric.

The present invention is illustrated by the following non-limiting examples:

EXAMPLES

Example 1

Preparation of Enzyme Particles Comprising Spray Dried Protease Enzyme in a PEG 4000 Wax Spray dried protease enzyme was prepared by conventional drying of a liquid solution of Savinase®—a protease commercially available from Novo Nordisk A/S Denmark—purified by removal of nonproteinaceous material. The spray dried powder obtained had the following characteristics:

Enzyme Activity: 89 KNPU/g

Dry Matter: 95% w/w

Particle size distribution: 99% w/w<60 microns 180 g PEG 4000 was transferred to a beaker in a water bath at 80° C. and kept there until it was melted. 20 g of spray dried Savinase® was added while stirring and a homogeneous suspension/dispersion was obtained. The suspension was poured on a table and cooled whereby the wax solidified. The solidified melt was crushed whereby the following particles were obtained:

Enzyme Activity: 8.0 KNPU/g

Particle size distribution: 250 micron<94%<850 micron

Bulk density: 0.54 g/ml

True density: 1.25 g/ml (measured in kerosene)

Example 2

Preparation of Enzyme Particles Comprising Spray Dried Protease Enzyme in a NAFOL 1822 Wax 5180 g NAFOL 1822 was transferred to a beaker in a water bath at 80° C. and kept there until it was melted. 20 g of spray dried Savinase® of example 1 was added while stirring. The homogeneous suspension was poured on a table and cooled whereby the wax solidified. The solidified melt was crushed whereby the following particles were obtained:

Enzyme Activity: 5.1 KNPU/g

Particle size distribution: 250 micron<95%<850 micron

Bulk density: 0.45 g/ml

True density: 0.96 g/ml (measured in kerosene)

Example 3

Preparation of Enzyme Particles Comprising Spray Dried Protease in PEG 4000 and NAFOL 1822 Waxes in Combination 90 g PEG 4000 and 90 g NAFOL 1822 was transferred to a beaker in a water bath at 80° C. and kept there until they were melted. 20 g of spray dried Savinase® of example 1 was added while stirring. The homogeneous suspension was poured on a table and cooled whereby the wax solidified. The solidified melt was crushed whereby the following particles were obtained:

Bulk density: 0.43 g/ml

True density: 1.06 g/ml (measured in kerosene)

As can be observed, the results obtained in this example shows the feasibility of combining in the process two different waxes having different true densities for preparing enzyme particles having a desired true density between the true densities of the individual waxes.

Example 4

A non-aqueous liquid detergent comprising enzyme containing particles is prepared according to example 1, page 31–35 in WO 99/00471 except for replacing the "enzyme prills" of WO 99/00471 with the particles of example 1 or 2 or 3, supra.

Example 5

Preparation of Enzyme Particles Comprising Spray Dried Protease Enzyme in PEG 4000 Wax 18 kg Savinase® concentrate was mixed with 3.24 kg Sodium sulfate. The mixture was spray dried by conventional methods as in example 1. The spray dried concentrate obtained an enzyme protease activity of 76 KNPU/g.

8.5 kg PEG 4000 was melted and 1.1 kg spray dried Savinase® was added while stirring. The suspension was spray-cooled in a spray-cooling tower and the resulting particles collected and siewed between 250 and 600 microns. This resulted in the following characteristics:

Activity: 9.4 KNPU/g

Bulk density: 0.69 g/ml

True density: 1.11 g/ml (measured in Softanol 50)

Example 6

Preparation of Enzyme Particles Comprising Spray Dried Protease Enzyme and Expancel Light Spheres (as Density Modifier) in PEG 4000 Wax 8.5 kg PEG 4000 was melted and 1.1 kg spray dried Savinase® (from example 5) was added while stirring. 960 grams Expancel 461DE20 lightspheres was added while stirring. The suspension was spray-cooled in a spray-cooling tower and the resulting particles collected and siewed between 250 and 600 microns. This resulted in the following characteristics:

Activity: 8.5 KNPU/g

Bulk density: 0.64 g/ml

True density: 1.04 g/ml (measured in Softanol 50)

Compared to example 5 the true density was significantly lowered

Example 7

Preparation of Enzyme Particles Comprising Spray Dried Protease Enzyme (Containing Thiosulfate) in PEG 4000 Wax 18 kg Savinase® concentrate was mixed with 1.62 kg Sodium sulfate and 1.62 kg Sodium thiosulfate (as antioxidant). The mixture was spray dried by conventional methods as in example 1. The spray dried concentrate obtained an enzyme protease activity of 71 KNPU/g.

8.5 kg PEG 4000 was melted and 1.1 kg spray dried Savinase® was added while stirring. The suspension was spray-cooled in a spray-cooling tower and the resulting particles collected and siewed between 250 and 600 microns. This resulted in the following characteristics:

Activity: 8.4 KNPU/g

Bulk density: 0.73 g/ml

True density: 1.16 g/ml (measured in Softanol 50)

Example 8

Preparation of Enzyme Particles Comprising Spray Dried Protease Enzyme (Containing Thiosulfate) and Expancel Light Spheres (as Density Modifier) in PEG 4000 Wax 8.5 kg PEG 4000 was melted and 1.1 kg spray dried Savinase® (from example 7) was added while stirring. 960 grams Expancel 461DE20 light spheres was added while stirring. The suspension was spray-cooled in a spray-cooling tower and the resulting particles collected and siewed between 250 and 600 microns. This resulted in the following characteristics:

Activity: 9.8 KNPU/g

Bulk density: 0.63 g/ml

True density: 1.04 g/ml (measured in Softanol 50)

Compared to example 7 the true density was significantly lowered

Example 9

Preparation of Enzyme Particles Comprising Spray Dried Protease Enzyme in Lutensol AT80 Wax 8.5 kg Lutensol AT80 was melted and 1.1 kg spray dried Savinase® (from example 5) was added while stirring. The suspension was spray-cooled in a spray-cooling tower and the resulting particles collected and siewed between 250 and 600 microns. This resulted in the following characteristics:

Activity: 9.1 KNPU/g

20 Bulk density: 0.62 g/ml

True density: 1.14 g/ml (measured in Softanol 50)

Example 10

Preparation of Enzyme Particles Comprising Spray Dried Protease Enzyme and Expancel Lightspheres in Lutensol AT80 Wax 8.5 kg Lutensol AT80 was melted and 1.1 kg spray dried Savinase® (from example 5) was added while stirring. 960 grams Expancel 461DE20 lightspheres was added while stirring. The suspension was spray-cooled in a spray-cooling tower and the resulting particles collected and siewed between 250 and 600 microns. This resulted in the following characteristics:

Activity: 8.5 KNPU/g

Bulk density: 0.53 g/ml

True density: 1.06 g/ml (measured in Softanol 50)

Compared to example 9 the true density was significantly lowered

Example 11

Preparation of Enzyme Particles Comprising Spray Dried Amylase Enzyme in PEG 4000 Wax 18 kg Duramyl® concentrate was mixed with 2.80 kg Sodium sulfate. The mixture was spray dried by conventional methods as in example 1. The spray dried concentrate obtained an enzyme amylase activity of 1650 KNU/g.

6.65 kg PEG 4000 was melted and 0.86 kg spray dried Duramyl® was added while stirring. The suspension was spray-cooled in a spray-cooling tower and the resulting particles collected and siewed between 250 and 600 microns. This resulted in the following characteristics:

Activity: 115 KNU(g)

True density: 1.18 g/ml (measured in Softanol 50)

Example 12

Preparation of Enzyme Particles Comprising Spray Dried Amylase Enzyme and Expancel Lightspheres in PEG 4000 Wax 5.5 kg PEG 4000 was melted and 1.4 kg spray dried Duramyl® (from example 11) was added while stirring. 115 grams Expancel 461DE20 lightspheres was added while stirring. The suspension was spray-cooled in a spray-cooling tower and the resulting particles collected and siewed between 250 and 600 microns. This resulted in the following characteristics:

Activity: 290 KNU/g

True density: 1.01 g/ml (measured in Softanol 50)

Compared to example 11 the true density was significantly lowered, even though the particles contained significantly more enzyme powder than in example 11.

Example 13

Preparation of Enzyme Particles Comprising Spray Dried Amylase Enzyme and Q-CEL Lightspheres in PEG 4000 Wax 5.5 kg PEG 4000 was melted and 1.27 kg spray dried Duramyl® (from example 11) was added while stirring. 140 grams Q-CEL 300 lightspheres was added while stirring. The suspension was spray-cooled in a spray-cooling tower and the resulting particles collected and siewed between 250 and 600 microns. This resuited in the following characteristics:

Activity: 300 KNU/g

True density: 1.10 g/ml (measured in Softanol 50)

Compared to example 11 the true density was significantly lowered even the particles contained significantly more enzyme powder than in example 11. Q-CEL 300 is though less efficient in reducing true density than Expancel used in example 12.

Example 14

A Non-aqueous Liquid Detergent Matrix was Prepared According to Guidelines Given in patent application WO 99/00478 Example 1, Not Adding the Dry Substances:

150 g Diethylenglycolmonobutylether 150 g Synperonic A7 (a POE-(7)-synthetic primary $C_{13}$/$C_{15}$ alcohol from ICI) was mixed at 45° C. for 5 minutes 150 g Dodecylbenzene sulfonic acid Na-salt (LAS) was added and the mixture was stirred for 30 minutes 0.5 g enzyme particles were added to 4 g detergent matrix. The visual appearance of the particles after 24 hours storage at room temperature was checked:

| Enzyme particle | Visual appearance |
|---|---|
| Example 5 | Intact particles |
| Example 6 | Intact particles |
| Example 7 | Intact particles |
| Example 8 | Intact particles |
| Example 9 | Intact particles |
| Example 10 | Intact particles |

all enzyme particles tested showed good physical stability in the detergent matrix.

What is claimed is:

1. A liquid composition comprising solid particles dispersed in a liquid phase, wherein the solid particles comprise a solid wax matrix in which an active is distributed, and wherein the solid particles have a true density between about plus 0.5 g/cm$^3$ to about minus 0.5 g/cm$^3$ of the true density of the liquid phase, and wherein the solid particles have a particle size of at least 50 $\mu$m.

2. The liquid composition of claim 1, wherein the wax matrix has a true density between about plus 0.5 g/cm$^3$ to about minus 0.5 g/cm$^3$ of the true density of the liquid phase.

3. The liquid composition of claim 1, wherein the liquid composition is substantially non-aqueous.

4. The liquid composition of claim 1, wherein the wax is water soluble or water dispersible.

5. The liquid composition of claim 1, wherein the wax is insoluble or indispersible in a substantially non-aqueous liquid.

6. The liquid composition of claim 1, wherein the wax is selected from the group consisting of polyethylene glycols, polypropylenes, polyethylenes, nonionic tenside waxes, ethyleneoxide, propyleneoxide or copolymers thereof, Carnauba wax, Candelilla wax, bees wax, hydrogenated ox tallow, hydrogenated palm oil, hydrogenated cotton seed, hydrogenated soy bean oil, fatty acid alcohols, monoglyceride, di-glyceride, fatty acids and paraffin.

7. The liquid composition of claim 6, wherein the polyethylene glycol is selected from the group consisting of PEG 1500, PEG 3000, PEG 4000, PEG 6000 and PEG 9000.

8. The liquid composition of claim 6, wherein the non-ionic tenside is an ethoxylated fatty alcohol.

9. The liquid composition of claim 1, wherein the solid particle comprises a solid wax matrix of a mixture of at least two solid waxes, wherein an active is distributed.

10. The liquid composition of claim 1, wherein the solid particle comprises a solid wax matrix, wherein an active and a density modifier are distributed in the wax matrix.

11. The liquid composition of claim 9, wherein the wax is water soluble or water dispersible.

12. The liquid composition of claim 9, wherein the wax is insoluble or indispersible in a substantially non-aqueous liquid.

13. The liquid composition of claim 9, wherein the wax has a melting point or range between about 35° C. to about 120° C.

14. The liquid composition of claim 9, wherein the amount of wax is at least 35% w/w of the particle.

15. The liquid composition of claim 9, wherein the wax is selected from the group consisting of polyethylene glycols, polypropylenes, polyethylenes, nonionic tenside waxes, ethyleneoxide, propyleneoxide or copolymers thereof, Carnauba wax, Candelilla wax, bees wax, hydrogenated ox tallow, hydrogenated palm oil, hydrogenated cotton seed, hydrogenated soy bean oil, fatty acid alcohols, monoglyceride, di-glyceride, fatty acids and paraffin.

16. The liquid composition of claim 15, wherein the polyethylene glycol is selected from the group consisting of PEG 1500, PEG 3000, PEG 4000, PEG 6000 and PEG 9000.

17. The liquid composition of claim 15, wherein the non-ionic tenside is an ethoxylated fatty alcohol.

18. The liquid composition of claim 9, wherein the wax matrix further comprises a density modifier.

19. The liquid composition of claim 10, wherein density modifier has a true density which is least 0.2 g/cm$^3$ below the true density of the wax matrix incorporating the enzyme.

20. The liquid composition of claim 1, wherein the solid particles are prepared by a process comprising the steps of:

(a) preparing a mixture, I, comprising a first wax and one or more additional waxes, having
  a lower or higher true density than the first wax; or
  preparing a mixture, II, comprising a first wax and a density modifier; or
  preparing a mixture, III, comprising a first wax and one or more additional waxes, having
    a lower or higher true density than the first wax and a density modifier, (b) dispersing or dissolving an active in mixtures I, II or III, and (c) preparing active containing particles by solidifying the dispersion or solution obtained in step (b).

21. The liquid composition of claim 1, wherein the active is in solid particulate form.

22. The enzyme containing particle of claim 9, wherein the active is in solid particulate form.

23. The enzyme containing particle of claim 10, wherein the active is in solid particulate form.

24. The composition of claim 20, wherein said first wax is in molten form.

25. The composition of claim 20, wherein said one or more additional waxes are in molten form.

26. A liquid composition comprising solid particles dispersed in a liquid phase, wherein the solid particles comprise a solid wax matrix in which an active is distributed, and wherein the solid particles have a true density between about plus 1.5 g/cm$^3$ to about minus 1.5 g/cm$^3$ of the true density of the liquid phase, and wherein the solid particles have a particle size of at least 50 $\mu$m.

27. The composition of claim 1, wherein the solid particles have a particle size of between 100 $\mu$m to 1000 $\mu$m.

28. The composition of claim 1, wherein the solid particles have a particle size of between 200 $\mu$m to 600 $\mu$m.

29. The composition of claim 1, wherein the solid particles have a particle size of between 50 $\mu$m to 200 $\mu$m.

30. The composition of claim 26, wherein the solid particles have a particle size of between 100 $\mu$m to 1000 $\mu$m.

31. The composition of claim 26, wherein the solid particles have a particle size of between 200 $\mu$m to 600 $\mu$m.

32. The composition of claim 26, wherein the solid particles have a particle size of between 50 $\mu$m to 200 $\mu$m.

* * * * *